US010548807B2

(12) United States Patent
Cartier

(10) Patent No.: US 10,548,807 B2
(45) Date of Patent: Feb. 4, 2020

(54) MASSAGE APPARATUS COMPRISING A STACK OF INFLATABLE AND DEFLATABLE CELLS INCLINED AND OVERLAPPING ONE ANOTHER

(71) Applicant: AC & CO TECHNOLOGIES, Ardentes (FR)

(72) Inventor: Claude Cartier, Ardentes (FR)

(73) Assignee: AC & CO TECHNOLOGIES, Ardentes (FR)

( * ) Notice: Subject to any disclaimer, the term of this patent is extended or adjusted under 35 U.S.C. 154(b) by 317 days.

(21) Appl. No.: 15/322,956

(22) PCT Filed: Jun. 30, 2015

(86) PCT No.: PCT/FR2015/051779

§ 371 (c)(1),
(2) Date: Dec. 29, 2016

(87) PCT Pub. No.: WO2016/001566

PCT Pub. Date: Jan. 7, 2016

(65) Prior Publication Data

US 2017/0224577 A1 Aug. 10, 2017

(30) Foreign Application Priority Data

Jul. 2, 2014 (FR) ..... 14 56300

(51) Int. Cl.
*A61H 9/00* (2006.01)
*A61H 23/04* (2006.01)
*A61H 1/00* (2006.01)

(52) U.S. Cl.
CPC ..... *A61H 9/0092* (2013.01); *A61H 1/008* (2013.01); *A61H 9/005* (2013.01); *A61H 9/0078* (2013.01);

(Continued)

(58) Field of Classification Search
CPC .. A61H 9/0078; A61H 9/0085; A61H 9/0092; A61H 2201/0103;

(Continued)

(56) References Cited

U.S. PATENT DOCUMENTS 3,659,593 A * 5/1972 Vail ..... A61H 9/0078 128/DIG. 15
4,029,087 A * 6/1977 Dye ..... A61B 17/135 601/152

(Continued)

FOREIGN PATENT DOCUMENTS

DE 8530876 U1 12/1985
DE 8620269 U1 10/1986

(Continued)

OTHER PUBLICATIONS

International Search Report dated Oct. 1, 2015 for corresponding International Application No. PCT/FR2015/051779, filed Jun. 30, 2015.

(Continued)

*Primary Examiner* — Tu A Vo
(74) *Attorney, Agent, or Firm* — David D. Brush; Westman, Champlin & Koehler, P.A.

(57) ABSTRACT

A pressotherapy apparatus including a device for forming a treatment enclosure to be placed around a section of the body. The device has inflatable and deflatable cells having an upper membrane and a lower membrane which are connected together. The cells are supported by an external wall opposite a body surface of the device. The cells are disposed in a stack between two end cells. The cells between the end cells are stacked by overlapping in a position inclined between a high-end near to the external wall and a low end near to the body surface. The cells of the stack have an active portion of the upper membrane extending from the (Continued)

low end not covered by the lower membrane of an adjacent cell above.

13 Claims, 2 Drawing Sheets

(52) U.S. Cl.
CPC ..... *A61H 23/04* (2013.01); *A61H 2201/0103* (2013.01); *A61H 2201/165* (2013.01); *A61H 2201/5056* (2013.01)

(58) Field of Classification Search
CPC ..... A61H 2201/165; A61H 2201/5058; A61H 2205/106; A61H 7/007; A61H 9/005; A61H 2201/0157; A61H 2201/164; A61H 2201/1642; A61H 2201/1645; A61H 2201/1647; A61H 2205/10; A61H 2209/00
See application file for complete search history.

(56) References Cited

U.S. PATENT DOCUMENTS

| | | | | | |
|---|---|---|---|---|---|
| 4,624,244 | A * | 11/1986 | Taheri | A61H 9/0078 | 128/DIG. 15 |
| 4,648,392 | A | 3/1987 | Cartier et al. | | |
| 4,699,424 | A * | 10/1987 | Andres | A47C 7/467 | 297/284.6 |
| 4,762,121 | A * | 8/1988 | Shienfeld | A61H 9/0078 | 601/152 |
| 4,941,458 | A * | 7/1990 | Taheri | A61H 9/0078 | 601/152 |
| 5,063,910 | A | 11/1991 | Cartier | | |
| 6,010,471 | A * | 1/2000 | Ben-Noon | A61F 5/05816 | 601/149 |
| 6,846,295 | B1 * | 1/2005 | Ben-Nun | A61F 13/08 | 128/DIG. 20 |
| 2004/0039432 | A1 * | 2/2004 | Warriner | A61F 7/02 | 607/108 |
| 2010/0031449 | A1 * | 2/2010 | Cheng | A61H 9/0078 | 5/713 |
| 2011/0009784 | A1 * | 1/2011 | Li | A61H 9/0092 | 601/151 |
| 2014/0276296 | A1 * | 9/2014 | Mansur, Jr. | A61H 9/0078 | 601/152 |

FOREIGN PATENT DOCUMENTS

| | | | |
|---|---|---|---|
| EP | 1213002 | A1 | 6/2002 |
| FR | 2144971 | A5 | 2/1973 |
| FR | 2511241 | A1 | 2/1983 |
| FR | 2572651 | A1 | 5/1986 |
| FR | 2639222 | A1 | 5/1990 |
| FR | 2950245 | A1 | 3/2011 |

OTHER PUBLICATIONS

Written Opinion of the International Searching Authority dated Oct. 1, 2015 for corresponding International Application No. PCT/FR2015/051779, filed Jun. 30, 2015.

English Translation of Written Opinion of the International Searching Authority dated Oct. 1, 2015 for corresponding International Application No. PCT/FR2015/051779, filed Jun. 30, 2015.

* cited by examiner

Fig. 3
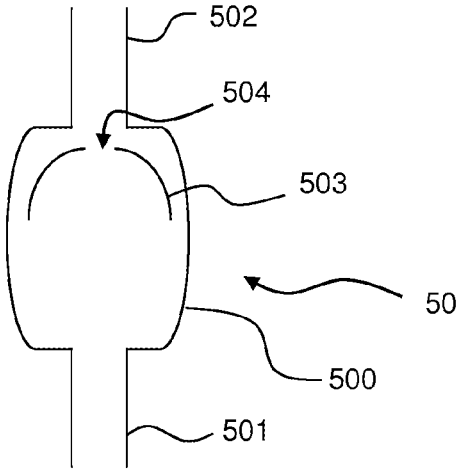
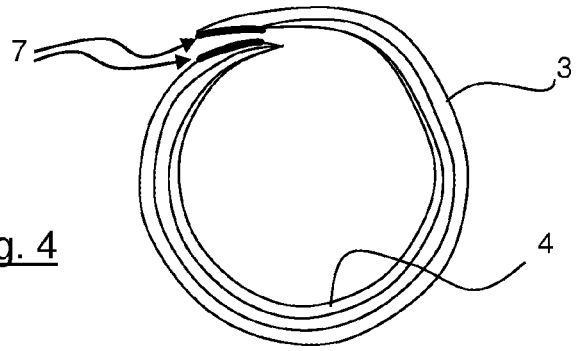
Fig. 4

MASSAGE APPARATUS COMPRISING A STACK OF INFLATABLE AND DEFLATABLE CELLS INCLINED AND OVERLAPPING ONE ANOTHER

CROSS-REFERENCE TO RELATED APPLICATIONS

This application is a Section 371 National Stage Application of International Application No. PCT/FR2015/051779, filed Jun. 30, 2015, the content of which is incorporated herein by reference in its entirety, and published as WO 2016/001566 on Jan. 7, 2016, not in English.

FIELD OF THE DISCLOSURE

The field of the invention is that of massage techniques or of lymphatic drainage of the human or animal body. More precisely, the invention relates to a pressotherapy apparatus implementing a system of inflatable and deflatable cells, connected to means for pressurising cells, able to be substituted for the use of mercury pressotherapy.

Such as will be explained more precisely in what follows, the absence of coherent pressotherapy with a high pressure gradient, in particular such as in the prior art described hereinafter, has given rise to the need to improve the existing pneumatic pressotherapy. As such are defined therapeutic needs that generate requirements with an unavoidable physical nature, structurally modifying the existing pneumatic pressotherapy means.

The invention can be applied in many applications, in the fields of comfort, well-being, aesthetics and, of course, in the medical field (with higher pressures as shall be explained in more detail in what follows).

In the field of aesthetics, an apparatus according to the invention can be used with for objective a reshaping, the obtaining of a thin leg, the elimination of cellulite (thigh and pelvis), in the framework of post-operative care, or for other aesthetical care. The apparatus can in this context be used by an individual or in an institute for example.

In the field of comfort, an apparatus according to the invention can be used in thalassotherapy, in spas, but also in the aeronautics field (air crews and/or passengers) and in the field of tourism. In this context, the apparatus can be used in an institute, individually, or on board aircraft, in airports, in large shopping centres, or in certain companies or in certain tourism activities.

In the field of well-being the apparatus according to the invention can be used in the case of feeling of heavy legs, swollen legs, with respect to oedema at the end of the day (which tends, without particular care, to develop into a definitive oedema), with respect to soreness, etc. In this context, the apparatus can be used individually or in an institute. Note that the apparatus can also be used in the field of sport and recovery after physical exertion.

In the medical field, the apparatus can be used in particular with respect to the following pathologies:

- post phlebitis and varicose venous pathologies: pain, heaviness, oedema, indurations (hypodermatitis), rebellious and recurrent ulcers;
- lymphatic pathologies among which:
  - seasonal and permanent primary oedemas;
  - radio-surgical secondary oedemas of cancers, parasitic (filariasis of the world's entire tropical belt), trauma, post-erysipelas and infections;
- veino-lymphatic pathologies;

- post-trauma pathology: post-fracture oedemas and pain, post-sprains and tears, algoneurodystrophies, superficial and deep tissue haematomas;
- muscle pathology (rebellious pain);
- peripheral rheumatic pathology of the members, frostbite and micro circulatory pathology;
- etc.

Note that an apparatus according to the invention can also be used on the animal body, for example in the equine field, and in particular in racing stables, breeding stables and sports stables.

BACKGROUND OF THE DISCLOSURE

In the medical field of the invention, it has been known for more than thirty years to exert a vascular massage, along with the manual lymphatic drainage techniques, which are not very effective, which theoretically act on the lymphatic flow, but which, in practice, are insufficient for absorbing incrusted oedemas. Vascular massage has a complementary purpose which is to filter out the tissues of the members, this by raising the excessive tissue liquids centripetally wherein they are absorbed into the remaining operational proximal lymphatic vessels, roots of members, axillary and inguinal of lymph nodes, and anastomoses of the torso where assistance can be had through manual manoeuvres for draining.

In the 1970s, at a time when pressotherapy was practised with a single bag, Doctor Claude-Julien Cartier had the idea to use the liquid state and the high density of metal mercury to drain the members by placing them vertically in a rigid enclosure (in the form of a bundle or of an arm sheath) and causing the mercury to rise along the member (protected by a neoprene membrane) at variable heights, and according to speeds and times that varied according to the pathology to be treated.

The work of Doctor Cartier was the object of two patent applications published under applications FR-2 572 651 and FR-2 639 222.

Pressotherapy with mercury brings the therapeutic field certain advantages, due to the application on the members of a substantial pressure gradient to disinfilter them, resulting in the following set:

- "the mercury means": perfect progressive and ascending annular moulding, with a high pressure gradient;
- "the mercury effect": action on the superficial and deep tissues resulting in:
  - an immediate blood volume flow expelled;
  - a tissue lymphatic release;
  - a secondary arterial dilatation;
  - eutrophic therapy of the interstitium (supporting tissue);
- "the mercury profile": muscle and ligament effectiveness, aesthetic reshaping of the member, fast action, sustainable action;
- "the mercury strategy": ambulatory treatment, simple to use, "works faster and farther", concrete result, short manipulations, precise protocols.

However, under ecological awareness, it has become imprudent to use mercury, and imperative to obtain the same effects without mercury.

Parallel to this work, Dr Cartier, due to his research, introduced into the minds of the manufacturers of pneumatic pressotherapy equipment the need to move from the single chamber to the juxtaposition of several chambers, then to carry out therein a pressure gradient but which will for them remain low (with the pressure gradient being 10 cm of mercury (Hg) for maximum pressures of 20 cm of Hg).

These techniques implement inflatable and deflatable cells connected to a pressurising system, comprised in practice of a compressor.

Several apparatuses according to this principle have been proposed in prior art.

In particular a massage sleeve is known described by the patent document published under number FR-2 511 241. The sleeve described comprises a plurality of cells arranged over the length of the sleeve, which can be inflated and deflated in order to exert a tightening pressure on a member of the body when this member is surrounded by the sleeve.

The sleeve comprises a flexible outer envelope comprising a plurality of individual compartments of which each one is provided to encircle the member when the latter is surrounded by the sleeve, and a plurality of inflatable bags of which each one can be received individually in one of the compartments of the flexible outer envelope. Each one of these bags comprises an orifice connector which passes through an opening formed in the flexible outer envelope for inflating and deflating bags.

Such a device is known and carried out in order to facilitate the repair of existing pressotherapy apparatuses by avoiding proposing a sleeve comprised of membranes forming cells that are integral with one another. As the bags are independent from one another, it is easy to replace them in case of need.

With such a device, according to the patent, the cells are flat in deflated state and cylindrical in inflated state. This results in a socking of the cells one on top of the other, arranging between the socks zones with a low pressure, even without pressure. The massage, and therefore the drainage, of the body surfaces treated is as such carried out in a very imperfect manner.

In practice, the cells of such an apparatus receive low pressures in absolute value, with maximum values of about 80 mmHg/cm2 and the pressure gradient, when it exists, remains very low ranging from 80 mmHg to 0 mmHg distributed over the entire member i.e. about 80 cm. And this device prohibits increasing the pressures without accentuating the strangulations by the sockings of the device.

The patent document published under number FR-2 950 245 described another pressotherapy device, according to which an enclosure forms a sleeve provided to cover a section of the body, with this enclosure comprising a plurality of compartments isolated by partitions, with these partitions each being joined at the periphery to the internal and external walls of the enclosure. In addition, the partitions are each provided with a series of perforations intended to create a loss of load between the entrance and the exit of the enclosure.

Such a device has several disadvantages among which:

- the manufacture of the enclosure with its internal partitions fixed at their periphery to the internal wall of the enclosure, appears relatively complex;
- the perforations of the internal partitions may not have sufficient resistance to the relatively substantial pressures, if it is desired to increase the therapeutic effectiveness;
- the internal wall of the enclosure, once the latter is under pressure, can, as previously, have the form of successive socks that are detrimental to an effective drainage.

Pressotherapy devices are known such as described in the patents published under numbers EP1213002A1, DE8530876U1, DE8620269U1, FR2144971A5 and FR2511241A1). These devices use sleeves comprised of a plurality of cells (or bags) that have, according to a cross-section, a profile that can be assimilated to that of a parallelogram, a diamond or an almond. As such, these cells make it possible to obtain a partial overlapping, ideally of about ⅓, having for result to allow these devices do not have any discontinuity in the pressure zones.

More precisely, these cells allow these devices to not have zones in which no pressure would be applied on a portion of the body.

However, such as explained hereinabove and contrary to mercury pressotherapy, these cells have a socking when they are used with high pressures, thus causing a discontinuity in the pressure gradient along the portion of the body whereon one of these devices is used.

The experience and the use of mercury having convinced as to the usefulness of the strong pressures and of their harmlessness in human therapy, the invention has in particular for objective to overcome the disadvantages of prior art, by applying in a very uniform manner progressive pressures that can be high (maximum from 500 to 800 mmHg/cm2).

SUMMARY

More precisely, the invention has for objective to propose a pressotherapy device, of the type implementing inflatable and deflatable cells, which make it possible to apply on a portion of the body a pressure that is exerted linearly over the height of the device, i.e. without discontinuity contrary to the device of prior art which generates a phenomenon of successive sockings.

The invention also has for objective to provide such a device that makes it possible to obtain a pressure gradient, similarly to mercury pressotherapy.

These objectives, as well as others that will appear in what follows, are achieved thanks to the invention which has for object a pressotherapy apparatus comprising a device for forming a treatment enclosure to be placed around a section of the body, the device comprising inflatable and deflatable cells having an upper membrane and a lower membrane which are connected together, the cells being supported by an external wall opposite a body surface of the device, characterised in that the cells are disposed in a stack between two end cells, the cells between the end cells being stacked by overlapping in a position inclined between a high end in the vicinity of the external wall and a low end in the vicinity of the body surface, the cells of the stack having an active portion of the upper membrane extending from the low end not covered by the lower membrane of an adjacent cell above.

As shall be explained in more detail in what follows, in a pressotherapy device according to the invention, the active portions of the upper membranes of the uncovered cells will, when the cells are inflated, be placed in the extension of one another, creating in this way a continuous pressure surface on the member, so as to transmit the pressure linearly over the height of the device.

Therefore in this way the formation of successive socks is prevented, which will make it possible to improve in particular the tissue drainage with a device according to the invention.

Such a device is therefore designed to be a substitute for mercury pressotherapy, while still reproducing its effectiveness without using mercury which has become a target of ecology.

Further recall that this pressure gradient must concern high pressure ranges in order to act on deep tissues and muscle compartments.

Recall that the application of a high pressure gradient on a body surface is a major imperative for the surface and deep effectiveness of a pressotherapy.

Yet, faced with the impossibility of continuing to have recourse to the high density compressive means which is mercury, the device according to the invention makes it possible to recreate a compressive ambience that drowns the surface to be treated in a pressure gradient that is as regular as possible and the closest as possible to that of mercury.

In addition, note that as the effectiveness of the compressive principle is no longer linked to weight, therefore to the verticality of the member to be treated, a device according to the invention is in particular applicable to the treatment of the torso and of the abdomino-lumbar belt, where mercury pressotherapy was not applicable.

The device according to the invention is therefore advantageous for the following reasons:

- the various compressive cells, advantageously flat when they are deflated, together have, in the inflated state, a continuous compressive state, by aligning end-to-end the active portions of the upper membranes that are flat or practically flat;
- maintained against one another, the various compressive cells can retain the thin walls while still receiving pressures that can be high according to their level along the pressure gradient created (about 500 mmHg/cm2 for well-being and 800 mmHg/cm2 in the medical field);
- the pressures contained in the compressive chambers superposed on the same location of the body are not added to one another at this location, as would the super-positioning of revolutions of elastic strips, but harmoniously "inter-communicate" their compressive effects in order to approach a linear gradient.

This results in that, as in the case of mercury pressotherapy, the high pressures are reflected from the body surface to the subcutaneous cellulitic tissues and to deep tendino-articular and muscle tissues, carrying out evacuating massages that are impossible without pressures and pressure gradients such as those provided by mercury pressotherapy.

The peripheral intensity of the pressures applied moreover generates secondary arterial vasodilatation when the compression is stopped, increasing the blood renewal on each peripheral circulatory micro unit where the arterial blood is "sucked" into the arterial capillaries, then pushed into a venous network with zero pressure as it is emptied of all content by the prior evacuating compression: such a favoured beneficial circulatory situation does not exist spontaneously in nature and is produced only thanks to such a method of draining and massaging.

Preferentially, the cells are of a substantially flat shape in the deflated state.

In this way, being flat in the deflated state, the active portion of the upper membrane of each uncovered cell will, after inflating of the corresponding cell, retain, after being moved, a flat or practically flat configuration.

In addition, thanks to the invention, the cells remain flat in a controlled manner during the inflating, preventing them from being transformed into inflating socks of which the shape would be unsuitable on the portion of the body treated, for the reasons mentioned hereinabove.

Preferentially, the cells have a cross-section that is identical between them.

As such, the cells can be manufactured in series, all identical, which makes it possible to reduce their cost of manufacture, and consequently, that of the pressotherapy device according to the invention.

According to the invention, the stacked cells overlap with an overlapping of two adjacent cells by ⅔ in height, and can reach up to 9/10.

With such overlappings, and preferentially with that providing two-thirds of covering, the transfer of the pressure to the low end of the cells is favoured which can be deformed to the body surface, while the rest of the cell is constrained by the adjacent cells. As indicated hereinabove, the overlapping of the cells between them does not generate any juxtaposition of pressures but, on the contrary, transfers the pressure in an optimum manner to the body surface which therefore makes it possible to perfectly control the pressure applied.

In other terms, each active portion of a cell exerts a skin contact on a section of the body for which the pressotherapy device according to the invention is used, with the pressure coming from this skin contact resulting from the overlapping (or from the stacking) of three different cells.

As such, according to the principle of the invention and contrary to prior art, the active portion of a first cell is deformed under the effect of the inflating of this first cell, but also under the effect of the inflating of at least two other cells underlying to this first cell. The overlapping of cells as such induces a relative stacking of at least three cells per active portion, as such making it possible to optimise the linear application of a pressure on a portion of the body by the intermediary of a plurality of active portions of cells of a sleeve according to the invention.

More precisely, the architecture (overlapping, stacking, etc.) of the cells of a device according to the invention allows these cells, and this even at high pressures, contrary to the devices of prior art, to have a continuity of the pressure zones as well as a continuity in the pressure gradient by the intermediary of the active portions of cells. Indeed, the inflating of a cell of a stack (or overlapping) also allows it to produce a containing and sheathing effect on the other cells of the stack (or overlapping). The containing and sheathing effect of each cell of a device according to the invention as such allows each one of these cells to present an active portion which, not resulting from the simple inflating of a single cell, does not produce any socking phenomenon during an inflating in the useable pressure range of the device according to the invention. According to a practical example:

- an overlapping of two adjacent cells by ⅔ in height induces finding for each pressure zone, according to a cross-section of the device, a first cell having an active portion and two other cells underlying to the first cell;
- an overlapping of two adjacent cells by 9/10 in height induces finding for each pressure zone, according to a cross-section of the device, a first cell having an active portion and nine other cells underlying to the first cell.

Advantageously, the cells include a chamber made of a sealed deformable material that can resist a pressure of at least 500 mmHg/cm2.

A pressotherapy device designed as such can be used for well-being as well as for medical applications.

In addition, thanks to this characteristic, the containing and sheathing effect of a cell in relation to other adjacent cells is reinforced. As such, the capacity of the active portion to be deformed (elastic deformation) is optimised in order to obtain the continuity of pressure zones combined with the continuity of the pressure gradient.

According to a particular embodiment, said chamber is covered with a fabric lining.

According to a preferred embodiment, the chambers are covered, on the side of the body surface, with an internal wall connected to the external wall in order to form a pocket inside of which the chambers are arranged, with the internal wall being able to act as a pressure distributor.

In this way, the covering on the side of the body surface acts as a distribution wall of the pressure on the surface of the member treated, contributing to applying the pressure in a continuous and linear manner. In other terms, the internal wall contributes in preventing the appearance of socks on the side of the body surface.

Advantageously, the cells are made integral two-by-two and individually to the external wall (flexible and inextensible)

In this way, the cells are maintained in position in relation to one another, therefore preventing them from sliding over one another, which would lead to reducing the active portion of the uncovered upper membrane, which would be detrimental to the effectiveness of the device.

In this case, the cells are preferentially made integral between them in a zone comprised in the first third of their height starting from the external wall, on their contact allowing for the entry/exiting of air.

As such, the displacement of the uncovered active portion of the upper membrane of the cells when the latter are inflated is advantageously preserved.

According to another characteristic of the invention, the cells are individually connected or in series to a pressure transmission circuit.

In this case, the circuit extends from an entry cell to a terminal cell, and includes load loss means between the cells between the entry cell and the terminal cell.

In this way, a pressotherapy device according to the invention advantageously reproduces the characteristics of the mercury pressotherapy according to prior art.

According to a preferred solution, each cell except for the terminal cell, is connected to the following cell, by going from the entry cell to the terminal cell, via an intermediary load loss cell.

In this way, the load loss can be perfectly controlled from one cell to another, and therefore over the entire height of the device.

According to a preferential embodiment, the intermediary load loss cells are bidirectional.

According to a preferred embodiment, the apparatus comprises means for closing the pressure transmission circuit, allowing for a sequential rise in pressure of the circuit.

This sequential rise in pressure can correspond, such as explained hereinafter, to an inflating of the cells according to next-to-next sequence, from one end of the sleeve to another end. According to another example of application, the sequential rise in pressure can correspond to an inflating of groups of adjacent cells, according to a predefined sequence, with the compression allowed by the device then being of a sector nature.

As such, by way of example, it is possible to individually treat, in a sector manner, the ankle-foot, the calf, the knee or the thigh, using a device according to the invention that would cover an entire lower member.

Advantageously, the device has a flat shape and is intended to be wound in order to form a sleeve around a section of the body, with the device comprising adjustable means for maintaining the sleeve in shape.

BRIEF DESCRIPTION OF THE DRAWINGS

Other characteristics and inventions shall appear more clearly when reading the following preferred embodiment of the invention, provided as a simple non-limited example for the purposes of illustration, and of the annexed drawings among which:

FIG. 3 is a diagrammatical cross-section representation of a load loss cell intended to be provided on a pressotherapy device according to the invention;

FIG. 4 is a cross-section view of a device according to the invention, in its wound configuration in order to form a treatment enclosure.

DETAILED DESCRIPTION OF ILLUSTRATIVE EMBODIMENTS

Figure 1:
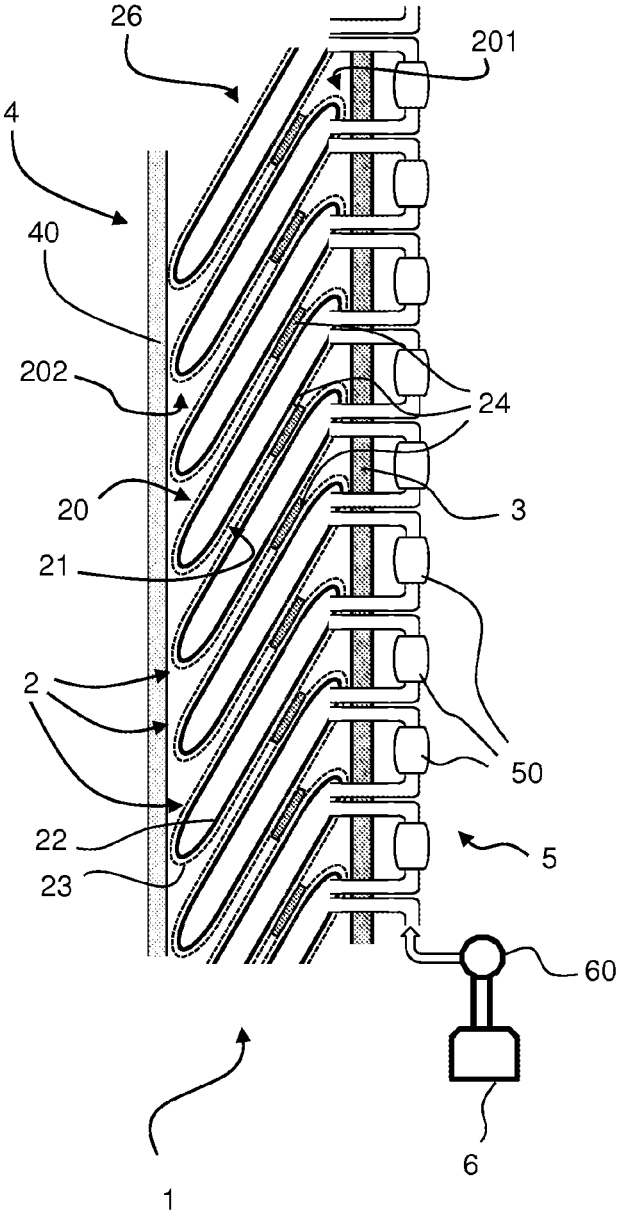
FIGS. 1 and 2 are partial cross-section views of a pressotherapy device according to the invention, viewed respectively in deflated state and in inflated state.
Figure 2:
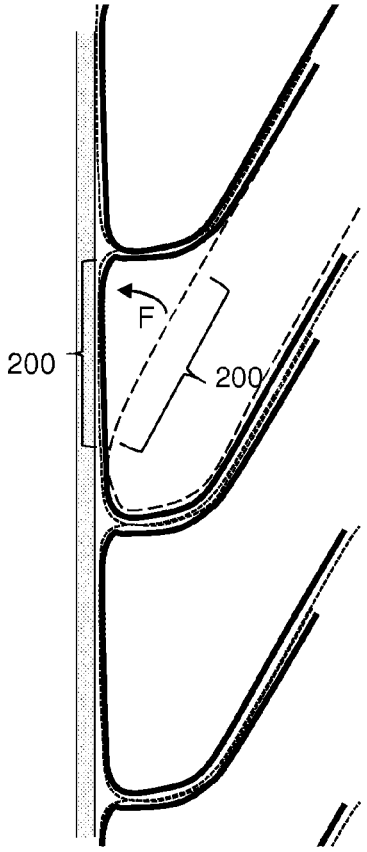

In reference to FIGS. 1 and 2, a pressotherapy apparatus according to the invention comprises a device 1 for forming a treatment enclosure such as shall be described in what follows, to be placed around a section of the body, with the device 1 comprising:

- a plurality of inflatable/deflatable cells 2, each having an upper membrane 20 and a lower membrane 21 which are connected together in order to form a chamber able to be inflated;
- a flexible and inextensible external wall 3, carrying the inflatable and deflatable cells, and intended to occupy a position opposite the side of the device forming the body surface 4 able to be brought into contact with a portion of the body to be treated;
- a compressor 6, coupled to the device in such a way as to be able to inflate the inflatable and deflatable cells of the latter (a pressure gauge 60 making it possible to check the pressure transmitted to the device).

According to the principle of the invention, the cells 2 are disposed in a stack between two end cells 25, 26, with the cells being stacked by being overlapped being inclined between a high end 201 in the vicinity of the external wall 3 and a low end 202 in the vicinity of the body surface.

Furthermore, the cells of the stack have an active portion 200 of the upper membrane not covered by the lower membrane of the adjacent cell, with this active portion 200 extending from the low end 202, i.e. starting from the vicinity of the body surface.

Note that the stack of cells is carried out in such a way that, on each autonomous circular skin contact, there is according to the invention three cells stacked on one another. In other terms, with an overlapping by a third of two adjacent cells, it is obtained, on each height of 9 cm over which a cell extends obliquely, three consecutive zones of compression of 3 cm in height, each one for an active portion of a cell (this aspect is not to scale in the FIGS. 1 and 2).

Inflatable and deflatable cells of a pressotherapy device stacked in compliance with the principle of the invention will behave in the following way.

When the compressor is operating and is pressurising the inflatable and deflatable cells, each cell between the end cells 25, 26 is pressed on its upper membrane 20 and on its lower membrane 21 by the adjacent cells between which the corresponding cell is taken in sandwich. This results in that, in the lower portion of these cells, i.e. in the vicinity of the body surface, only the portion of the cell extending over the length of the active portion 200 of the uncovered upper membrane can be deformed during the pressurising of the cell, tending to inflate the latter.

The inflation of this part of the cell is shown in FIG. 2.

Such as is shown in FIG. 2, the inflating of the cells between the end cells 25, 26 results in a deformation of the cell in its lower portion, in the vicinity therefore of its low end, which generates the displacement of the uncovered upper membrane towards the body surface such as symbolised by the arrow F.

In other terms, the cell is inflated in the only free portion between the upper membrane of the cell in the deflated state, the body surface and the adjacent cell placed above.

Such as shown in FIG. 2, all of the active portions 200 of the uncovered membranes of the cells will behave identically. Consequently, the uncovered active portions 200 of the upper membranes will be displaced in such a way as to come into alignment with one another, in such a way as to form a continuous or practically continuous pressure surface or on the body surface of the device.

In addition, according to the invention, the stacked cells overlap by two-thirds of the upper membrane of each cell, with this overlapping able however to reach up to 9/10.

The extent of the overlapping contributes to obtaining a flat or practically flat active portion 200 against the body surface and to approach a linear gradient on each autonomous circular skin contact.

In addition, the assurance of achieving this result is increased by implementing cells 2 with a substantially flat shape in the deflated state.

In other terms, as shown by the cross-section of the cells 2 shown in FIG. 1, in deflated state, the cells have an upper membrane and a lower membrane parallel between them and, extending substantially straight between the high end and the low end of the corresponding cell, and being in the vicinity of one another in deflated state.

This results in that the active portion 200 of the uncovered upper membrane is itself relatively flat, or at the very least straight, and retains over its low distance due to the overlapping, this straight profile once the cell is inflated.

In addition, as can be seen in FIG. 1, the cells all have the same cross-section.

According to a preferred embodiment, the cells 2 are carried out in the following way:

- they include a chamber 22 made of a sealed deformable material, such as neoprene or polyurethane, able to resist a pressure of at least 500 mmHg/cm2;
- each chamber 22 is covered with a fabric lining 23;
- the cells are made integral two-by-two, in a zone 24 comprised in the first third of their height starting from the external wall 3;
- the high end of each cell is attached on the external wall 3 on the level of the entry/exit of air of the air circulation circuit;
- the cells are covered, on the side of the body surface 4 with an internal wall 40 connected to the external wall in order to form a pocket inside of which the cells are arranged.

The internal wall 40 constitutes an intermediate element between the treatment enclosure and the skin surface. It can be derived from silicone (or be made of silicone), of a thickness of from 3 to 5 mm and wound on the member. Such an intermediate element makes it possible to homogenise the pressures applied and to play the role of a "pressure distributor" thanks to its conditions of elasticity making it possible to diffuse the pressure that it receives in one point over a more extended skin surface.

In other terms, the flexible and inextensible internal wall, acting as a "pressure distributor", makes it possible to smooth out amongst them the juxtaposed pressures exerted by the active portions of the cells as such making it possible to optimise the capacity of the pressotherapy device, according to the invention, in reproducing the linear pressure gradient applied by mercury pressotherapy.

Moreover, note the fastening between them of the fabric linings 23 that surround the inflatable cells: resistance seams and with diagonals of the surfaces with respect to the fabric linings sheathing the inflatable cells (or any other solid means of fastening, for example via welds), on the upper ⅔ of their anterior wall and the lower ⅔ of their posterior wall, as well as the same type of fastening of these fabric linings on the external wall of the treatment enclosure on the upper ⅓ of the posterior face of each one of them and on the totality of the posterior wall of the lowest pocket.

According to an advantageous optimal characteristic, the internal wall integrates means of heating.

According to another characteristic of the invention, the cells are connected in series by a pressure transmission circuit 5, with the circuit extending from the entry cell 25 to the terminal cell 26.

Advantageously, this circuit includes load loss means between the entry cell 25 and the terminal cell 26.

Such as shown in FIG. 1, each cell except for the terminal cell is connected to the following cell (moving from the entry cell towards the terminal cell) by an intermediary load loss cell 50.

In reference to FIG. 3, the load loss cells 50 include:

- a hollow body 500 communicating with an inlet duct 501 and with an outlet duct 502;
- a valve 503, provided with an orifice 504 that is smaller than the orifice 502, with the valve 503 being deformable between a position of reducing the passage (load loss) of the cell (when the air circulates from inlet duct to the outlet duct), and a free circulation position when the air circulates from the inlet duct to the outlet duct.

Such a load loss cell provided with this valve is therefore bidirectional, between free circulation in one direction and load loss in the other direction.

As such, by going from the outlet ducts to the inlet ducts and by the controlled closing of the circuit after the entry cell (this by using a suitable means that authorise the closing of the circuit), a rapid inflating of the cells at low pressure is carried out, with this pressure being balanced between all of the cells.

If the circulation in the circuit is reversed, the pressure gradient is installed, due to the load loss from one cell to another, from the entry cell to the terminal cell.

In addition, upon control, when the circuit operating in the direction of establishing the gradient, is closed beyond the terminal cell or at any other level, the rise in pressure upstream of the closing in order to simulate a powerful massage can be continued, such as the one that would be exerted by several physiotherapists simultaneously.

By opening the circuit again, the pressure gradient is reinstalled again, following which it is again possible to simulate a powerful massage by closing the circuit such as described hereinabove, then opening the circuit, and so on.

The opening of the circuit upstream of the entry cell causes the pressure to drop, which can be accelerated by a depressurising which deflates the cells.

With a device such as described hereinabove, it is possible to apply pressures that are relatively high, of about 500 mmHg/cm2 in the field of well-being and of about 800 mmHg/cm2 in the medical field.

Note that the loss of load preferentially integrated into the operation of the device can be obtained according to other embodiments that can be considered. For example, each cell is individually supplied by a device with increasing load loss from the entry cell to the terminal cell.

In addition, a pressotherapy apparatus according to the invention makes it possible, under control, to increase, substantially or not, the maximum pressure of the bottom portion with ascending progression along the part of the body covered by the pressotherapy device, towards its top portion, in order to simulate a genuine manual massage equivalent to the action of three or four masseur-physiotherapists acting together on the same patient.

According to another example, the pressotherapy apparatus according to the invention makes it possible, under control, to apply a predefined pressure sequentially or not, over a precise section of the body. In other terms, the pressotherapy apparatus according to the invention makes it possible to sectorise the application of a pressure on a portion of the body, and, in particular, to target the ankle-foot, the calf, the knee or the thigh.

Furthermore, as in the case with mercury pressotherapy, the high pressures are reflected from the body surface to the subcutaneous cellulitic tissues, deep tendino-articular and muscle tissues, carrying out evacuating massages thanks to the high pressures and to the pressure gradients.

According to another characteristic of the invention shown in FIG. 4, the device has a flat shape and is intended to be wound in order to form a sleeve around a portion of the body. In addition, the device comprises adjustable means 7 for maintaining the device in the form of a sleeve, with these means able to take the particular shape of self-attaching strips or zippers.

Although the present disclosure has been described with reference to one or more examples, workers skilled in the art will recognize that changes may be made in form and detail without departing from the scope of the disclosure and/or the appended claims.

The invention claimed is:

1. A pressotherapy apparatus comprising:

a device for forming a treatment enclosure to be placed around a section of the body, with the device comprising inflatable/deflatable cells having an upper membrane and a lower membrane which are connected together, the inflatable/deflatable cells being supported by an external wall opposite a body surface of the device, wherein the inflatable/deflatable cells are disposed in a stack between two inflatable/deflatable end cells, the inflatable/deflatable cells between the inflatable/deflatable end cells being stacked by overlapping in a position inclined between a high end in a vicinity of the external wall and a low end in a vicinity of the body surface, the inflatable/deflatable cells of the stack having an active portion of the upper membrane extending at the low end, the active portion is not covered by the lower membrane of an adjacent inflatable/deflatable cell above, wherein in an inflated state, only a portion of an inflatable/deflatable cell extending over a length of the active portion of the upper membrane that is not covered is configured to deform during a pressuring of the inflatable/deflatable cell, and wherein adjacent inflatable/deflatable cells in the stack overlap by ⅔ to 9/10 in a height of each inflatable/deflatable cell to form a relative stacking of at least three cells per active portion, between the body surface of the device and the external wall, the height being measured from the high end in the vicinity of the external wall and the low end in the vicinity of the body surface.

2. The pressotherapy apparatus according to claim 1, wherein the inflatable/deflatable cells are of a substantially flat shape in a deflated state.

3. The pressotherapy apparatus according to claim 1, wherein the inflatable/deflatable cells have a cross-section that is identical between the inflatable/deflatable cells.

4. The pressotherapy apparatus according to claim 1, wherein the inflatable/deflatable cells include a chamber made of a sealed deformable material able to resist a pressure of at least 500 mmHg.

5. The pressotherapy apparatus according to claim 4, wherein the chambers are coated, on a side of the body surface, with an internal wall connected to the external wall in order to form a pocket inside of which the chambers are arranged, with the internal wall being able to act as a pressure distributor.

6. The pressotherapy apparatus according to claim 1, wherein at least a first inflatable/deflatable cell and an adjacent second inflatable/deflatable cell of the inflatable/deflatable cells are integral to one another.

7. The pressotherapy apparatus according to claim 1, wherein the inflatable/deflatable cells are integral with the external wall, the external wall being flexible and inextensible.

8. The pressotherapy apparatus according to claim 1, wherein the inflatable/deflatable cells are connected individually or in series to a pressure transmission circuit.

9. The pressotherapy apparatus according to claim 8, wherein the pressure transmission circuit extends from an entry inflatable/deflatable cell to a terminal inflatable/deflatable cell, and includes at least one load loss cell between the entry inflatable/deflatable cell and the terminal inflatable/deflatable cell.

10. The pressotherapy apparatus according to claim 9, wherein each inflatable/deflatable cell except for the terminal inflatable/deflatable cell is connected to a following inflatable/deflatable cell in the stack, by going from the entry inflatable/deflatable cell to the terminal inflatable/deflatable cell, via a respective load loss cell of the at least one load loss cell.

11. The pressotherapy apparatus according to claim 8, wherein the pressure transmission circuit comprises a controlled circuit closure for closing the pressure transmission circuit, allowing for a sequential rise in pressure of the pressure transmission circuit.

12. The pressotherapy apparatus according to claim 1, wherein each inflatable/deflatable cell is individually supplied by a load loss device with increasing load loss from the entry inflatable/deflatable cell to the terminal inflatable/deflatable cell.

13. Pressotherapy apparatus according to claim 1, wherein the device has a flat shape and is configured to be wound in order to form a sleeve around a portion of the body, with the device comprising an adjustment for maintaining in the form of a sleeve.

* * * * *